US011284704B2

(12) United States Patent
Berrouard

(10) Patent No.: US 11,284,704 B2
(45) Date of Patent: Mar. 29, 2022

(54) PUSH BROOM HEAD AND METHOD OF FABRICATION THEREOF

(71) Applicant: GARANT GP, Saint-Francois (CA)

(72) Inventor: Mathieu Berrouard, Levis (CA)

(73) Assignee: GARANT GP

( * ) Notice: Subject to any disclaimer, the term of this patent is extended or adjusted under 35 U.S.C. 154(b) by 108 days.

(21) Appl. No.: 16/834,962

(22) Filed: Mar. 30, 2020

(65) Prior Publication Data

US 2020/0315335 A1 Oct. 8, 2020

Related U.S. Application Data

(60) Provisional application No. 62/829,248, filed on Apr. 4, 2019.

(51) Int. Cl.

| | |
|---|---|
| ***A46D 1/00*** | (2006.01) |
| ***A46D 1/08*** | (2006.01) |
| ***A46D 3/00*** | (2006.01) |
| ***A46B 9/02*** | (2006.01) |
| ***A46B 9/06*** | (2006.01) |

(52) U.S. Cl.

CPC ..... *A46B 9/06* (2013.01); *A46B 9/025* (2013.01); *A46D 1/0207* (2013.01); *A46D 1/08* (2013.01); *A46D 3/00* (2013.01); *A46B 2200/302* (2013.01)

(58) Field of Classification Search

CPC .. A46B 9/02; A46B 9/025; A46B 9/06; A46B 2200/302; A46D 1/0207; A46D 1/08; A46D 3/00

See application file for complete search history.

(56) References Cited

U.S. PATENT DOCUMENTS

| | | | | |
|---|---|---|---|---|
| 2,043,758 | A * | 6/1936 | Lay | A46B 9/06 15/159.1 |
| D265,697 | S | 8/1982 | Libman et al. | |
| 4,468,830 | A | 9/1984 | Batchelor | |
| 4,468,832 | A | 9/1984 | Batchelor | |
| 4,509,224 | A | 4/1985 | Batchelor | |
| 4,524,938 | A | 6/1985 | Strahs et al. | |
| 4,528,713 | A | 7/1985 | Libman | |
| 4,550,829 | A | 11/1985 | Strahs | |
| 4,553,282 | A | 11/1985 | Batchelor | |
| D284,908 | S | 8/1986 | Libman | |

(Continued)

FOREIGN PATENT DOCUMENTS

| | | |
|---|---|---|
| CA | 130330 S | 1/1911 |
| CA | 762138 A | 7/1967 |

(Continued)

*Primary Examiner* — Randall E Chin

(74) *Attorney, Agent, or Firm* — Lavery, De Billy, LLP; Gwendoline Bruneau

(57) ABSTRACT

A push broom head comprising a base with a leading edge and a trailing edge separated by a width of the base; and tufts of bristles extending from a surface of the base; the tufts of bristles being arranged in rows of bristles of decreasing stiffness from the leading edge to the trailing edge of the base, with a leading row of very stiff bristles and a trailing row of bendable bristles, thereby combining increased ease of handling by a user for an efficient sweeping action, the leading rows loosening and moving heavier particles and the trailing rows loosening and moving finer particles not acted upon by the stiff leading rows.

5 Claims, 5 Drawing Sheets

(56) References Cited

U.S. PATENT DOCUMENTS

| | | | | |
|---|---|---|---|---|
| D287,173 | S | 12/1986 | Libman | |
| 4,706,323 | A | 11/1987 | Batchelor | |
| 4,723,663 | A | 2/1988 | Learn | |
| 4,756,039 | A | 7/1988 | Pardo | |
| 4,792,256 | A | 12/1988 | Batchelor | |
| 4,794,663 | A | 1/1989 | Vosbikian | |
| 4,831,678 | A * | 5/1989 | Dietsche | B25G 3/08 15/176.4 |
| D302,759 | S | 8/1989 | Batchelor | |
| D303,178 | S | 9/1989 | Saunders | |
| D303,323 | S | 9/1989 | Saunders | |
| 4,862,550 | A | 9/1989 | Batchelor | |
| D304,649 | S | 11/1989 | Saunders | |
| D306,525 | S | 3/1990 | Saunders | |
| D306,526 | S | 3/1990 | Saunders | |
| D307,674 | S | 5/1990 | Saunders | |
| D307,981 | S | 5/1990 | Saunders | |
| D315,642 | S | 3/1991 | Furgale | |
| 5,010,616 | A | 4/1991 | Berti | |
| D320,889 | S | 10/1991 | Berti | |
| D332,701 | S | 1/1993 | Berti | |
| D346,905 | S | 5/1994 | Berti | |
| D348,357 | S | 7/1994 | Libman | |
| 5,337,440 | A | 8/1994 | Vosbikian et al. | |
| 5,343,586 | A | 9/1994 | Vosbikian | |
| 5,350,111 | A | 9/1994 | Vosbikian | |
| 5,367,737 | A | 11/1994 | Vosbikian et al. | |
| 5,371,916 | A | 12/1994 | Vosbikian | |
| D354,170 | S | 1/1995 | Libman | |
| 5,412,835 | A | 5/1995 | Vosbikian et al. | |
| 5,415,343 | A | 5/1995 | Vosbikian | |
| 5,425,153 | A | 6/1995 | Vosbikian | |
| D364,962 | S | 12/1995 | Vosbikian | |
| 5,502,862 | A | 4/1996 | Vosbikian | |
| 5,537,707 | A * | 7/1996 | Middleton | A46B 17/02 15/106 |
| D383,269 | S | 9/1997 | Berti | |
| D386,908 | S | 12/1997 | Berti | |
| D387,910 | S | 12/1997 | Berti | |
| 5,839,145 | A | 11/1998 | Petner | |
| D411,920 | S | 7/1999 | Vosbikian et al. | |
| D412,065 | S | 7/1999 | Berti | |
| D412,248 | S | 7/1999 | Berti | |
| 5,920,945 | A | 7/1999 | Libman | |
| 6,128,800 | A | 10/2000 | Vosbikian | |
| D433,571 | S | 11/2000 | Ancona et al. | |
| 6,321,409 | B1 | 11/2001 | Libman | |
| D455,562 | S | 4/2002 | Libman | |
| D456,617 | S | 5/2002 | Libman | |
| D456,618 | S | 5/2002 | Libman | |
| 6,393,647 | B1 | 5/2002 | Libman | |
| 6,419,415 | B1 | 7/2002 | Vosbikian et al. | |
| 6,594,850 | B2 | 7/2003 | Libman et al. | |
| 6,606,756 | B2 | 8/2003 | Fernandez | |
| 6,658,689 | B2 | 12/2003 | Vosbikian | |
| 6,820,301 | B2 | 11/2004 | Petner | |
| D501,088 | S | 1/2005 | Libman et al. | |
| 6,851,153 | B2 | 2/2005 | Lehman | |
| 6,872,026 | B2 | 3/2005 | Petner | |
| D509,066 | S | 9/2005 | Vosbikian | |
| D509,364 | S | 9/2005 | Berti | |
| D509,659 | S | 9/2005 | Weaver | |
| D509,661 | S | 9/2005 | Berti | |
| D509,964 | S | 9/2005 | Berti | |
| D511,046 | S | 11/2005 | Berti | |
| 6,971,138 | B2 | 12/2005 | Berti | |
| D515,822 | S | 2/2006 | Libman et al. | |
| 7,065,824 | B2 | 6/2006 | Petner | |
| 7,131,170 | B2 | 11/2006 | Weaver | |
| 7,152,748 | B2 | 12/2006 | Vosbikian | |
| D537,255 | S | 2/2007 | Berti | |
| 7,178,681 | B2 | 2/2007 | Libman | |
| 7,290,311 | B2 | 11/2007 | Vosbikian et al. | |
| D561,476 | S | 2/2008 | Vosbikian et al. | |
| D568,616 | S | 5/2008 | Berti | |
| 7,537,115 | B2 | 5/2009 | Weaver | |
| 7,549,194 | B2 | 6/2009 | Vosbikian et al. | |
| 7,717,524 | B2 | 5/2010 | Weaver | |
| 7,721,380 | B2 | 5/2010 | Libman et al. | |
| 7,730,571 | B2 | 6/2010 | Libman | |
| 7,819,487 | B2 | 10/2010 | Weaver | |
| D627,978 | S | 11/2010 | Libman | |
| 8,028,366 | B2 * | 10/2011 | Grabowski | A46B 9/02 15/106 |
| 8,402,590 | B1 | 3/2013 | Larson | |
| 8,904,591 | B2 | 12/2014 | Vosbikian et al. | |
| 8,925,134 | B2 | 1/2015 | Vosbikian et al. | |
| D785,948 | S | 5/2017 | Weaver et al. | |
| 9,655,492 | B2 | 5/2017 | Schiavo et al. | |
| 9,681,789 | B2 | 6/2017 | Weaver et al. | |
| D798,519 | S | 9/2017 | Libman et al. | |
| D828,668 | S | 9/2018 | Libman et al. | |
| 2003/0226784 | A1 | 12/2003 | Petner et al. | |
| 2005/0263466 | A1 | 12/2005 | Libman | |
| 2005/0285439 | A1 | 12/2005 | Kubaitis | |
| 2006/0010848 | A1 | 1/2006 | Vosbikian | |
| 2006/0117511 | A1 * | 6/2006 | Weaver | A46B 7/04 15/175 |
| 2006/0225251 | A1 | 10/2006 | Vosbikian et al. | |
| 2006/0230562 | A1 | 10/2006 | Vosbikian et al. | |
| 2007/0101529 | A1 | 5/2007 | Garcia | |
| 2007/0180639 | A1 | 8/2007 | Libman et al. | |
| 2008/0189887 | A1 | 8/2008 | Vosbikian et al. | |
| 2009/0211935 | A1 | 8/2009 | Weaver | |
| 2010/0212096 | A1 | 8/2010 | Libman | |
| 2011/0308025 | A1 | 12/2011 | Vosbikian et al. | |
| 2012/0180235 | A1 | 7/2012 | Libman et al. | |
| 2012/0195674 | A1 | 8/2012 | Mandle et al. | |
| 2013/0319195 | A1 | 12/2013 | Talken et al. | |
| 2017/0156562 | A1 | 6/2017 | Schiavo et al. | |
| 2017/0172288 | A1 | 6/2017 | Bart et al. | |
| 2018/0015607 | A1 | 1/2018 | Weaver et al. | |
| 2018/0070790 | A1 | 3/2018 | Weaver et al. | |

FOREIGN PATENT DOCUMENTS

| | | | |
|---|---|---|---|
| CA | 914865 | A | 11/1972 |
| CA | 941560 | A | 2/1974 |
| CA | 1219408 | A | 3/1987 |
| CA | 1219409 | A | 3/1987 |
| CA | 2560184 | A1 | 10/2005 |
| CA | 2676366 | A1 | 10/2005 |
| CA | 114433 | S | 4/2007 |
| CA | 170282 | S | 5/2017 |
| CA | 2894258 | C | 3/2018 |
| CA | 1775935 | S | 7/2018 |
| CN | 201551272 | U | 8/2010 |
| CN | 106667385 | A | 5/2017 |
| EP | 0129639 | A1 | 1/1985 |
| EP | 1129658 | A1 | 9/2001 |
| EP | 1753317 | A1 | 4/2009 |
| WO | 2005094434 | A3 | 10/2005 |
| WO | 2007092685 | A3 | 8/2007 |
| WO | 2008097334 | A1 | 8/2008 |
| WO | 2012103453 | A3 | 8/2012 |

* cited by examiner

PUSH BROOM HEAD AND METHOD OF FABRICATION THEREOF

CROSS REFERENCE TO RELATED APPLICATIONS

This application claims benefit of U.S. provisional application serial No. U.S. 62/829,248, filed on Apr. 4, 2019. All documents above are incorporated herein in their entirety by reference.

FIELD OF THE INVENTION

The present invention relates to push brooms. More precisely, the present invention relates to a push broom head and a method of fabrication thereof.

BACKGROUND

Different types of push brooms typically apply to different types of anticipated particles to be swept and to different types of sweeping surfaces, based on the fact that different type of bristles removing different types of particles depending on the sweeping surface.

Some broom heads combine bristles of different stiffness so as to efficiently remove a range of particles in one operation with a single broom. It has been found that coarse forward bristles are efficient in sweeping heavy particles while rear less coarse bristles take up finer materials that are not picked up by the coarser front bristles.

A number of configurations for broom heads were presented, including for example finer-bristled, softer border with a coarse, stiffer center section; or coarser front bristles and longer, finer rear bristles.

There is still a need in the art for a push broom head and a method of fabrication thereof.

SUMMARY OF THE INVENTION

More specifically, in accordance with the present invention, there is provided a push broom head, the push broom head comprising a base, the base comprising a leading edge and a trailing edge separated by a width of the base; and tufts of bristles of a same free length extending from a surface of the base; wherein the tufts of bristles are arranged in rows of bristles of decreasing stiffness from the leading edge to the trailing edge of the base.

There is further provided a method for making a push broom head, the method comprising providing a base having a leading edge and a trailing edge; and securing rows of bristles of decreasing stiffness from the leading edge to the trailing edge of the base.

Other objects, advantages and features of the present invention will become more apparent upon reading of the following non-restrictive description of specific embodiments thereof, given by way of example only with reference to the accompanying drawings.

DESCRIPTION OF EMBODIMENTS OF THE INVENTION

The present invention is illustrated by the following non-limiting examples.

Figure 1:
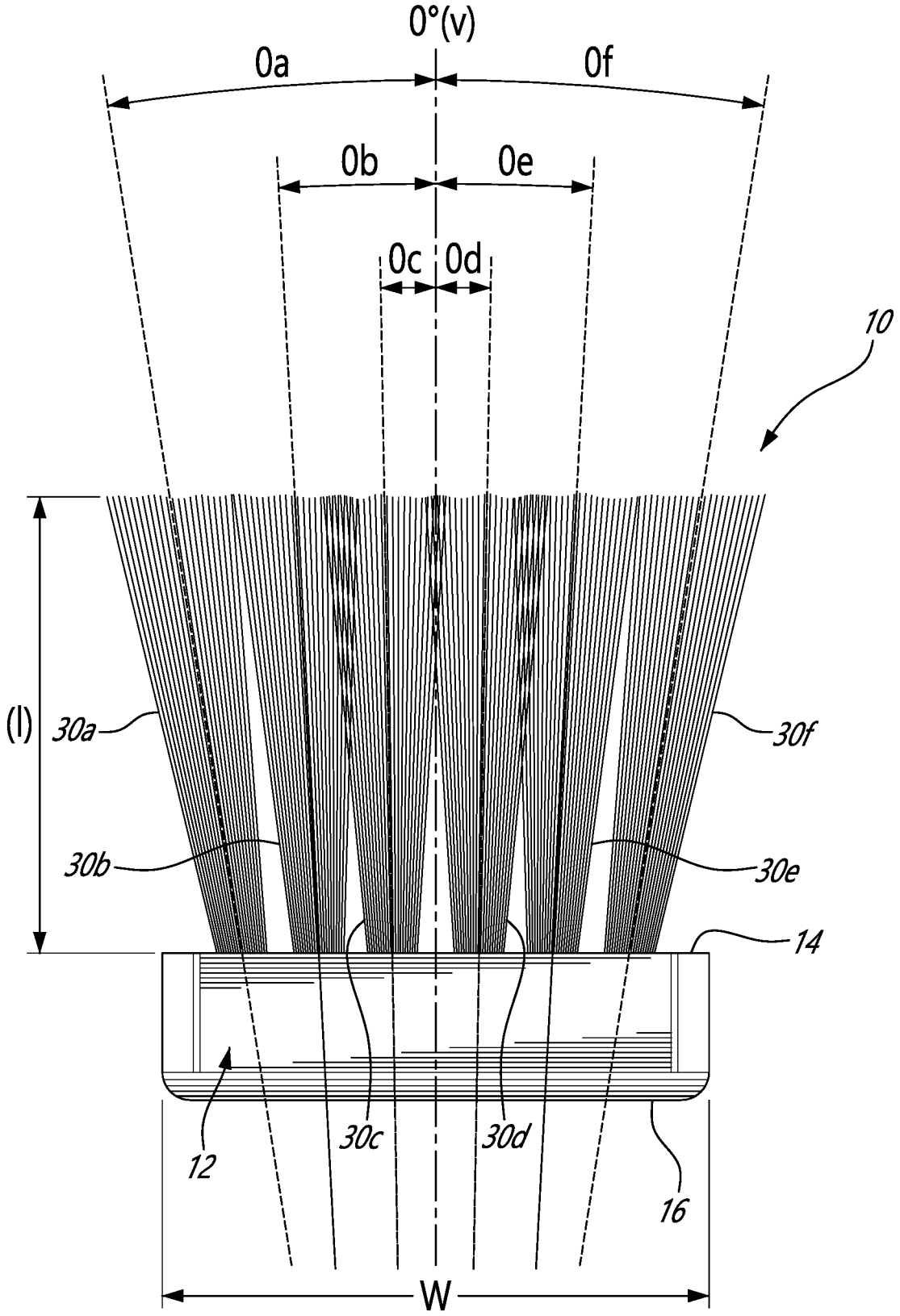
FIG. 1 is a side view of a broom head at rest according to an embodiment of an aspect of the present disclosure.
Figure 2:
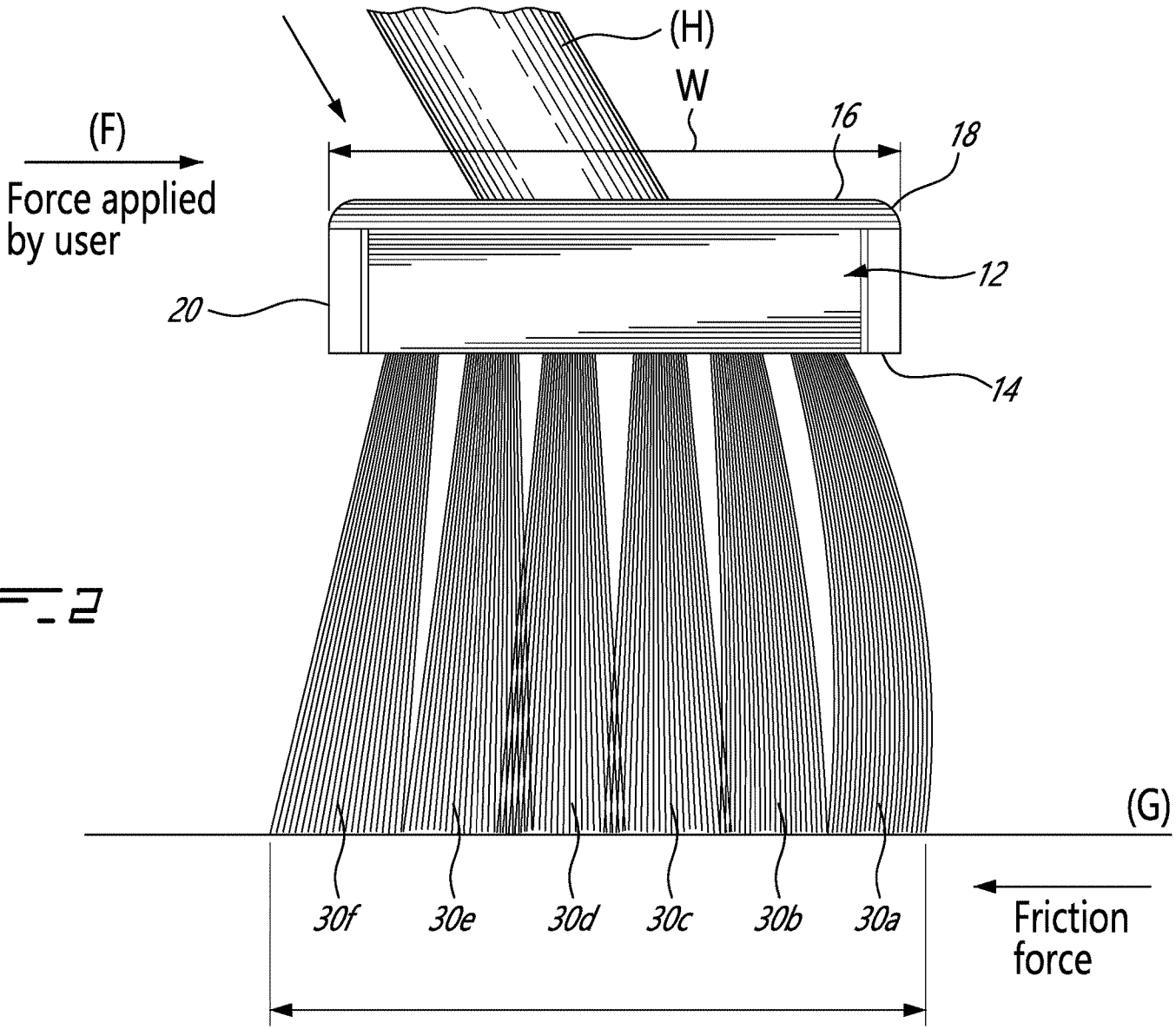
FIG. 2 is a side view of a broom head at rest according to an embodiment of an aspect of the present disclosure in use.

A broom head 10 as illustrated for example in FIGS. 1 and 2, comprises a base 12 having an upper surface 16 and a lower surface 14, the lower surface 14 facing a surface to be swept in normal use. The base 12 has a central vertical axis (V), and may be connected at a distal end of a handle (H) (not shown in FIG. 1) for use by an operator. The base 12 has a leading edge 18 and a trailing edge 20 separated by a width W.

The base 12 supports bristles or tufts of bristles extending from the surface facing a surface to be swept in normal us, i.e. the lower surface 14 in the present example.

In embodiments illustrated herein, tufts of bristles are arranged in rows generally parallel to the leading edge 18 and the trailing edge 20 of the base 12.

In FIG. 1, tufts 30*a*-30*f* are made of bristles of a same free length (I) from the lower surface 14 of the base 12 to their free end. The bristles may be in PE, PET, PP or PVC for example.

The central lines of the rows are extrapolated by dashed lines in FIG. 1 outwardly from their respective bristle free ends to show rest angles θa-θf relative to the central vertical axis (V) of the base 12. The rest angles indicate the inclination of the tufts from the central vertical axis (V) when no pressure is applied thereto, i.e. typically when the broom head is at rest and not being used against a surface to be swept.

Figure 3:
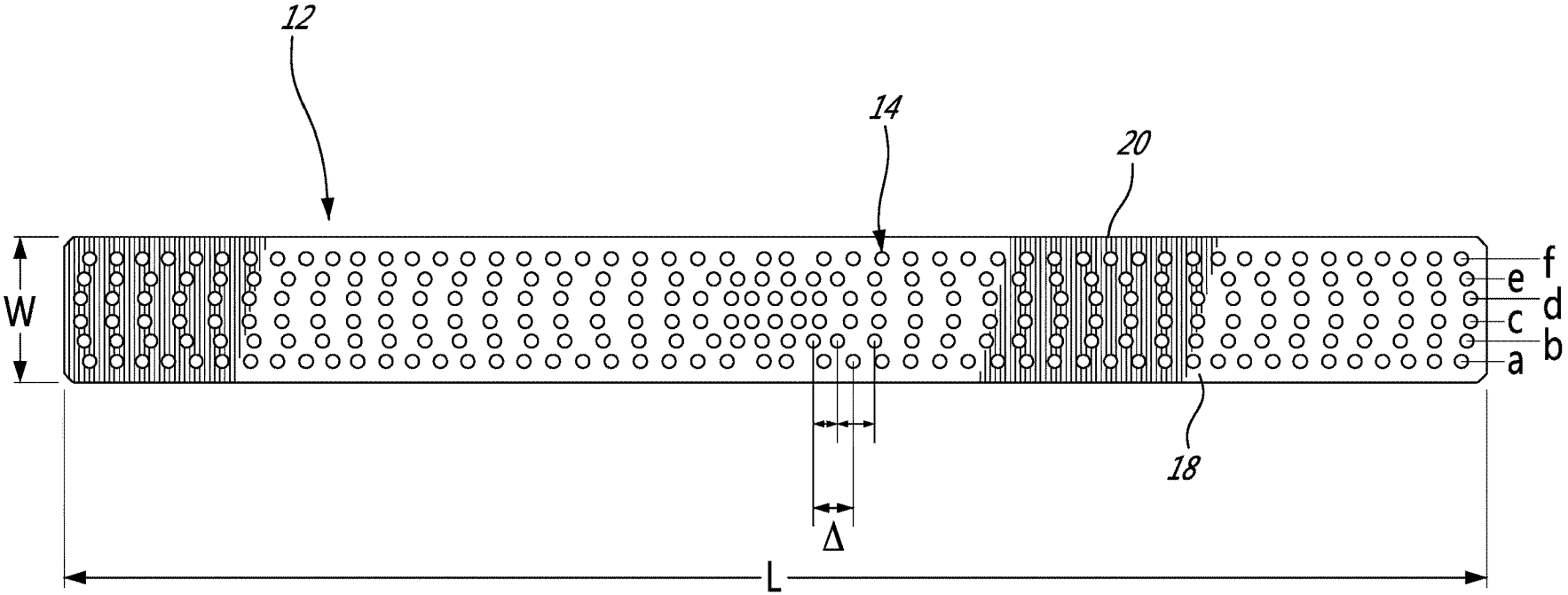
FIG. 3 is a bottom view of a broom head base according to an embodiment of an aspect of the disclosure.

Leading rows, referring to rows positioned closest to the leading edge 18 of the base 12, for example within the first third of the width W of the base 12 from the leading edge 18, comprise rows of tufts 30*a* and 30*b* of very stiff bristles. For example, PVC bristles of a diameter 0.060" for a length of 2.9', with rest angles θa of about 9°, and θb of about 6° respectively are selected. At least two leading rows a and b of very stiff tufts are used, and they are offset along the length L of the base 12 (see Δ in FIG. 3 for example) in such a way that the tufts of the two rows are not aligned in the direction of the width W of the base 12 so that the pair of rows of very stiff bristles together form a generally continuous barrier of very stiff bristles on the leading edge of the broom head.

Middle rows immediately downstream of the leading rows from the leading edge of the base, i.e. for example within the middle third of the width W of the base 12, comprise tufts 30*c* and 30*d* of bristles having a smaller stiffness that the leading rows, such as for example PET bristles of a diameter of about 0.029" for the same length (I) of 2.9', with rest angles θc of about 1°, and θd of about 1° respectively.

A trailing row, i. e closest the trailing edge 20 of the base 12, comprise tufts of bristles 30*f* having a still smaller stiffness, for example PET bristles of a diameter of about 0.018" for a length of 2.9', with a rest angle θf of about −9°. The bristles of the tufts 30*d* may be flagged, for increased picking up efficiency of finer particles such as dust fine.

Additional tufts 30*e* may be provided between the middle rows and the trailing row, for picking up finer particles such as dust or sand. The additional tufts of bristles 30*e* may have a stiffness smaller than the tufts of bristles of the trailing row, for example PET bristles of a diameter of about 0.014" for a length (l) of 2.9°, with rest angle θe of about −6°. At a constant diameter and free length and type of material, these bristles of tufts 30*e* may be crimped.

Table I summarizes such arrangement

TABLE I

| PET bristles | length Ø | stiffness | Inclination θ relative to the base of the brush head |
|---|---|---|---|
| First and second leading rows a-b | 2.9" .060" | ++ | 9°, 6°, |
| Middle rows c-d | 2.9" .029" | – | 1°, 1° |
| row e | 2.9" .014" (crimped) | – | −6° |
| Trailing row f | 2.9" .018" (flagged) | – | −9°; |

Figure 4:
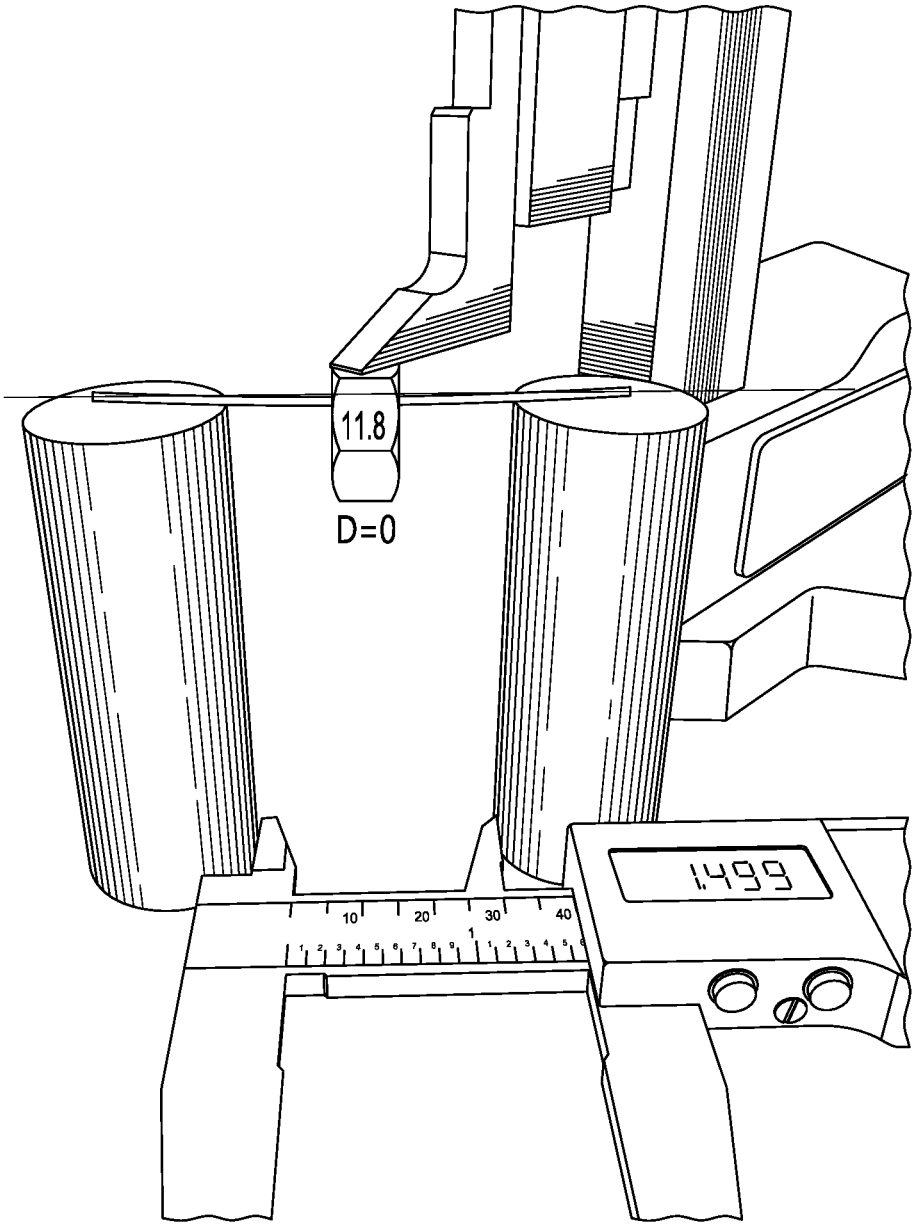
FIG. 4 shows a test to assess stiffness of bristles.
Figure 5:
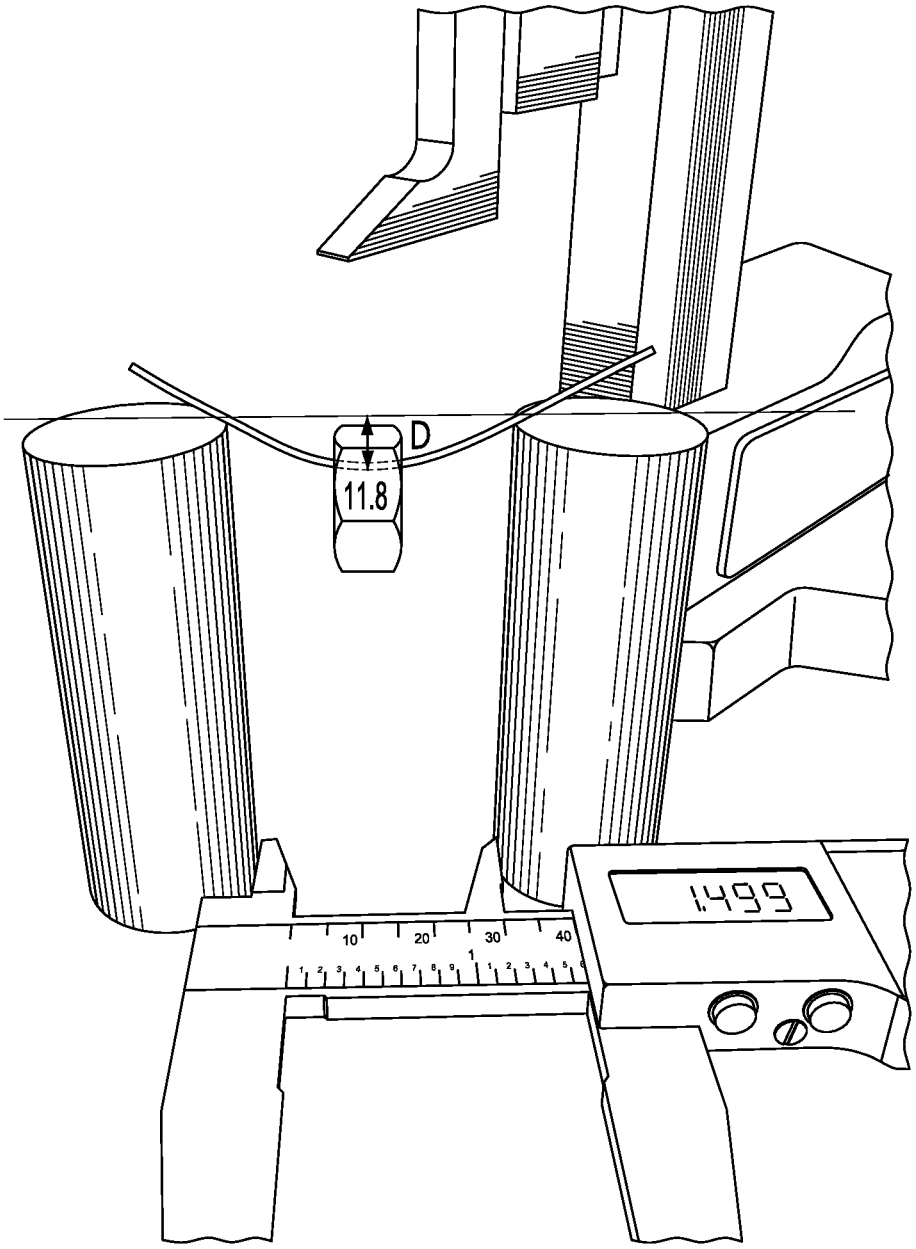
FIG. 5 shows a test to assess stiffness of bristles.

Stiffness—, also referred herein as rigidity, may be characterized by the deformation of bristles when submitted to a force, as shown in FIGS. 4 and 5 for example, and Table II below:

TABLE I

| rows | Applied force (N) | Deformation D (po) | Deformation D/applied Force |
|---|---|---|---|
| a and b | 0.1161504 | 0.016 | 0.137752431 |
| c and d | 0.1161504 | 0.0355 | 0.305638207 |
| e | 0.0244269 | 0.1185 | 4.851209118 |
| f | 0.1161504 | 0.25 | 2.15238174 |

The rigidity (stiffness) may be obtained as the ratio of the applied load over deformation. Under a same load, the deformation of the bristles of the leading rows (a, b) is 0.016 po as opposed to 0.25 po for the bristles of the trailing row (f); yielding a ratio of the rigidity of the bristles of the leading rows (a, b) over the rigidity of the bristles of the trailing row (f) of 0.25/0. 016=15.6, meaning that the rigidity of the bristles of the leading rows is 15.6 times larger than the rigidity of the bristles of the trailing row. The ratio of the rigidity of the bristles of the leading rows (a, b) over the rigidity of the bristles of the middle rows (c, d) is 0.0355/0. 016=2.2, meaning that the rigidity or stiffness of the bristles of the leading rows is 2.2 times larger than the rigidity of the bristles of the middle rows. The ratio of the rigidity of the bristles of the middle rows (c, d) over the rigidity of the bristles of the trailing row (f) of 0.25/0.0355=7, meaning that the rigidity of the bristles of the middle rows (c, d) is 7 times larger than the rigidity of the bristles of the trailing row (f).

The ratio of the rigidity of the bristles of the bristles of the trailing row (f) over the rigidity of the additional row (e) may be obtained as 4,8512/2,152 (see last column of Table II)=2.27 meaning that the rigidity of the bristles of the of the trailing row the trailing row (f) is 2.27 times larger than the rigidity of the bristles of the additional row (e).

According to an embodiment of an aspect of the present disclosure, a ratio of the rigidity of the bristles of the leading rows over the rigidity of the bristles of the trailing row is selected in a range between about 10 and about 20. The ratio of the rigidity of the bristles of the leading rows over the rigidity of the bristles of the middle rows may be selected in a range between about 1.5 and about 20, for example of about 2 in the example above. The ratio of the rigidity of the bristles of the middle rows over the rigidity of the bristles of the trailing row may be selected between about 1.5 and about 20, for example of about 7.0.

The present push broom head thus comprises very stiff bristles on the leading edge thereof, amounting for about ⅓ of the number of tufts of the broom head, and much less stiff or unbending under a same load, bristles downstream of the leading rows from the leading edge, especially bendable tufts of bristles in the trailing row. The bristles may be in a same material, and of a same free length from the surface of the broom head. The rest angle of the very stiff bristles on the leading edge may be selected of most 10° and the rest angle d for the trailing rows may be selected of at most −10°.

Under use, when a user applies a force (F) to the broom head, the very stiff bristles at the leading edge of the broom head resist folding backwards from the leading edge upon contacting the surface being swept (G) and when the friction surface between the surface being swept (G) and the bristles increases, as schematically shown in FIG. 2.

As a result, resistance to the user's force (F) is reduced, hence an increased ease of handling by the user for an efficient sweeping action, the leading rows loosening and moving heavier particles and the trailing rows loosening and moving finer particles not acted upon by the stiff leading rows.

Moreover, the bristles at the trailing edge, although more bendable and typically finer, i.e. of a reduced diameter, are protected against premature or excessive wear as the leading edge of the broom head, i.e. the stiff leading rows, supports the pressure.

The present broom head is thus efficient both on a range of particles sizes, from heavier to finer particles, and on a range of surfaces, from smooth to very rough, while preventing premature or excessive wear of any of the leading or trailing bristles.

The scope of the claims should not be limited by the embodiments set forth in the examples, but should be given the broadest interpretation consistent with the description as a whole.

The invention claimed is:

1. A method for making a push broom head, comprising:

providing a base having a leading edge and a trailing edge;

securing, from the leading edge to the trailing edge of the base, a leading row of bristles of a first stiffness and a trailing row of bristles of a second stiffness; and securing middle rows of bristles of a third stiffness between the leading row and the trailing row;

wherein the first stiffness is selected between 10 and 20 times larger than the second stiffness and a ratio of a stiffness of the bristles of the middle rows over the second stiffness is selected between about 1.5 and about 20.

2. The method of claim 1, comprising securing, from the leading edge to the trailing edge of the base, a first leading and a second leading rows of bristles, the second leading row being offset relative to the first leading row along a length of the base; and a trailing row of bristles of a stiffness between 10 and 20 times smaller than a stiffness of the first and second leading rows.

3. The method of claim 1, comprising further securing a handle on the base.

4. The method of claim 1, comprising securing, from the leading edge to the trailing edge, at least two leading rows and a trailing row, wherein the bristles of the leading rows amount for about ⅓ of a number of tufts of the broom head.

5. A method for making a push broom head, comprising:

providing a base, the base comprising a leading edge and a trailing edge separated by a width of said base;

securing tufts of bristles extending from a surface of the base;

wherein said securing tufts of bristles extending from a surface of the base comprises arranging tufts of in rows of bristles of decreasing stiffness from said leading edge to said trailing edge of the base, said rows comprising leading rows and trailing rows, a ratio of the rigidity of the bristles of the leading rows over the rigidity of the bristles of the trailing rows being selected in a range between 10 and 20, further comprising securing middle rows between said leading rows and said trailing rows, and securing additional tufts of bristles between the middle rows and the trailing rows, said additional tufts of bristles having a stiffness smaller than the stiffness of the bristles of the trailing rows.

* * * * *